US009208735B2

(12) United States Patent
Zhang

(10) Patent No.: US 9,208,735 B2
(45) Date of Patent: Dec. 8, 2015

(54) VOLTAGE ADJUSTMENT METHOD AND APPARATUS OF LIQUID CRYSTAL DISPLAY PANEL

(75) Inventor: Peilin Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 411 days.

(21) Appl. No.: 13/297,698

(22) Filed: Nov. 16, 2011

(65) Prior Publication Data

US 2012/0120124 A1 May 17, 2012

(30) Foreign Application Priority Data

Nov. 17, 2010 (CN) ..... 2010 1 0549181

(51) Int. Cl.
*G09G 3/36* (2006.01)

(52) U.S. Cl.
CPC ..... *G09G 3/3648* (2013.01); *G09G 2300/0434* (2013.01); *G09G 2320/0204* (2013.01); *G09G 2320/0247* (2013.01); *G09G 2320/0257* (2013.01); *G09G 2320/046* (2013.01); *G09G 2320/0673* (2013.01); *G09G 2320/0693* (2013.01); *G09G 2360/145* (2013.01)

(58) Field of Classification Search
CPC ..... G09G 2320/0247; G09G 2320/0257; G09G 2320/0673; G09G 2320/0693; G02F 2001/133397
USPC ..... 345/204.69
See application file for complete search history.

(56) References Cited

U.S. PATENT DOCUMENTS

| | | | | |
|---|---|---|---|---|
| 8,188,952 | B1 * | 5/2012 | Orlando et al. | 345/87 |
| 2005/0062704 | A1 * | 3/2005 | Whittington et al. | 345/89 |
| 2008/0278470 | A1 * | 11/2008 | Im et al. | 345/211 |
| 2009/0079688 | A1 * | 3/2009 | Chen et al. | 345/102 |
| 2010/0033413 | A1 * | 2/2010 | Song et al. | 345/89 |
| 2010/0073339 | A1 * | 3/2010 | Lee et al. | 345/207 |

FOREIGN PATENT DOCUMENTS

| | | | |
|---|---|---|---|
| CN | 1632647 | A | 6/2005 |
| CN | 101046567 | A | 10/2007 |
| CN | 101645244 | A | 2/2010 |
| KR | 20030073071 | A | 9/2003 |

* cited by examiner

*Primary Examiner* — Koosha Sharifi-Tafreshi
*Assistant Examiner* — Chun -Nan Lin
(74) *Attorney, Agent, or Firm* — Ladas & Parry LLP

(57) ABSTRACT

A voltage adjustment method and apparatus of a liquid crystal display (LCD) panel. The method comprises: acquiring initial reference voltage (RV) values of gamma voltage pairs corresponding to respective gray scales, which includes a first and a second gamma voltage; fixing the first gamma voltages, adjusting respectively the second gamma voltages in accordance with flicker values of the brightness of the LCD panel and the initial RV values of the second gamma voltages, and acquiring the adjusted voltage values of the second gamma voltages; and adjusting synchronously, with an equal proportion, the initial RV value of the first gamma voltage and the adjusted voltage value of the second gamma voltage corresponding to each gray scale respectively, so that the brightness corresponding to the gray scale is adjusted to be the same as the brightness corresponding to the same gray scale in the gamma standard voltage curve.

4 Claims, 6 Drawing Sheets

VOLTAGE ADJUSTMENT METHOD AND APPARATUS OF LIQUID CRYSTAL DISPLAY PANEL

CROSS REFERENCE TO RELATED APPLICATIONS

The present application claims priority to Chinese patent application number 201010549181.5 filed on Nov. 17, 2010 which is incorporated herein by reference in its entirety.

TECHNICAL FIELD

The present disclosure relates to technology of liquid crystal display, especially to a voltage adjustment method and apparatus of a liquid crystal display panel.

BACKGROUND

Currently TFT-LCD (Thin Film Transistor Liquid Crystal Display) products have been applied widely in people's productions and livings, including televisions, monitors and portable electronic display products etc. The image sticking of a display panel becomes one of main factors affecting the display picture quality of a product. The image sticking is a phenomenon occurring inside a liquid crystal cell. Due to displaying of a static picture for a long time, when changing into other images, the liquid crystal molecules can not be deflected in time and thoroughly to adapt to a new picture, so that the pattern of the original image still remains, thus affecting the display effect. In accordance with the difference in the shape and the location, the image sticking may be classified into two types, that is, the area image sticking and the line image sticking. The main reason of producing the image sticking is the influence of residual charges, which includes different distributions of polarization charges generated inside a liquid crystal cell in externally applied electric field and impurity charges inside the liquid crystal cell. These residual charges will affect the orientations of liquid crystals at the top and the bottom of the liquid crystal cell, so that the image sticking occurs in the whole panel area, and it is more severely distributed at the image junction position with obvious color difference. However, the electric field applied within a liquid crystal cell of an FFS (Fringe Field Switching) mode liquid crystal display panel is a horizontal electric field which is produced on the substrate on one side of a TFT such that the polarization charges and the impurity charges within the liquid crystal cell aggregate more easily in the electric field, that is, the phenomenon of the image sticking occurs more easily.

In the prior art, the image sticking is eliminated mainly by adjusting the voltage of a TFT-LCD product, that is, by testing a VT curve to determine the voltage of an intermediate gray scale (L127), and then by adjusting the voltage of a common electrode such that the flicker value of a display screen corresponding to the gray scale is the minimum, thereby fixing the voltage of the common electrode, and further adjusting other gamma voltage pairs so that the transmittances of respective gray scales are the same as that on the gamma standard curve.

However, the voltage adjustment method in the prior art considers only the matching between the transmittances of respective gray scales and the gamma standard curve, therefore, the voltages set by the method may be asymmetrical with respect to the voltage of the common electrode, thereby producing a direct current biased electric field, so that ions within the liquid crystal cell aggregate, which affects the liquid crystal deflection within the liquid crystal cell, resulting in that the phenomenon of the image sticking occurs on the display panel. For an FFS mode liquid crystal display panel, the image sticking produced by such a case is more severe.

SUMMARY

Embodiments of the present invention provides a voltage adjustment method and apparatus of a liquid crystal display panel to effectively reduce the generation of direct current biased charges within a liquid crystal cell so as to avoid affecting the liquid crystal deflection due to the aggregation of ions within the liquid crystal cell, so that the image sticking phenomenon of the liquid crystal display panel is improved, and the display quality of the liquid crystal display panel is advanced.

The present disclosure provides a voltage adjustment method of a liquid crystal display panel, including:

acquiring initial reference voltage values of gamma voltage pairs corresponding to respective gray scales in accordance with a voltage-transmittance curve and a gamma standard voltage curve of the liquid crystal display panel, the gamma voltage pair including a first gamma voltage and a second gamma voltage;

fixing the first gamma voltages corresponding to respective gray scales, adjusting respectively the second gamma voltages corresponding to respective gray scales in accordance with flicker values of the brightness of the liquid crystal display panel and the initial reference voltage values of the second gamma voltages corresponding to respective gray scales, and acquiring the adjusted voltage values of the second gamma voltages; and adjusting synchronously, with an equal proportion, the initial reference voltage value of the first gamma voltage and the adjusted voltage value of the second gamma voltage corresponding to each gray scale respectively, so that the brightness corresponding to the gray scale is adjusted to be the same as the brightness corresponding to the same gray scale in the gamma standard voltage curve.

Another embodiment of the present disclosure provides a voltage adjustment apparatus of a liquid crystal display panel, comprising:

an acquisition module which acquires initial reference voltage values of gamma voltage pairs corresponding to respective gray scales in accordance with a voltage-transmittance curve and a gamma standard voltage curve of the liquid crystal display panel, the gamma voltage pair including a first gamma voltage and a second gamma voltage;

a first adjustment module which fixes the first gamma voltages corresponding to respective gray scales, adjusts respectively the second gamma voltages corresponding to respective gray scales in accordance with flicker values of the brightness of the liquid crystal display panel and the initial reference voltage values of the second gamma voltages corresponding to respective gray scales, and acquires the adjusted voltage values of the second gamma voltages; and a second adjustment module which adjusts synchronously, with an equal proportion, the initial reference voltage value of the first gamma voltage and the adjusted voltage value of the second gamma voltage corresponding to each gray scale respectively, so that the brightness corresponding to the gray scale is adjusted to be the same as the brightness corresponding to the same gray scale in the gamma standard voltage curve.

The voltage adjustment method and apparatus of the liquid crystal display panel provided by the embodiments of the present disclosure acquire the initial reference voltages of the gamma voltage pairs corresponding to respective gray scales in accordance with the VT curve and the gamma standard voltage curve of the liquid crystal display panel at first, and then adjust the voltage values of the second gamma voltages of the gamma voltage pairs such that the flicker value of the brightness of the liquid crystal display panel is the minimum corresponding to the control of the initial reference voltages of the first gamma voltages and the adjusted voltage values of the second gamma voltages, and acquire the adjusted voltage values of the second gamma voltages, and further adjust the initial reference voltage values of the first gamma voltages and the adjusted voltage values of the second gamma voltages synchronously with an equal proportion such that the gamma voltage curve of the liquid crystal display panel is matched with the gamma standard voltage curve. By adjusting the voltage values of the gamma voltage pairs such that the flicker value of the brightness of the liquid crystal display panel is the minimum, and matching the gamma voltage pair with the gamma standard voltage curve, the present disclosure effectively reduces the generation of direct current biased charges in the liquid crystal cell, and avoids from affecting the liquid crystal deflection due to the aggregation of ions in the liquid crystal cell, thus the image sticking phenomenon of the liquid crystal display panel is improved, and the display quality of the liquid crystal display panel is advanced.

BRIEF DESCRIPTION OF THE DRAWINGS

The present invention will become more fully understood from the detailed description given hereinafter and the accompanying drawings which are given by way of illustration only, and thus are not limitative of the present invention and wherein.

DETAILED DESCRIPTION

In order to make the objects, technical solutions and advantages of the embodiments of the present invention more clear, in the following, the technical solutions of the embodiments of the present disclosure will be described clearly and completely in combination with the attached drawings of the embodiments of the present disclosure. Obviously, the described embodiments are only some embodiments of the present disclosure, but not all of the embodiments. Based on the embodiments of the present disclosure, all of other embodiments obtained by those of ordinary skill in the art without inventive efforts belong to the protection scope of the present disclosure.

Figure 1:
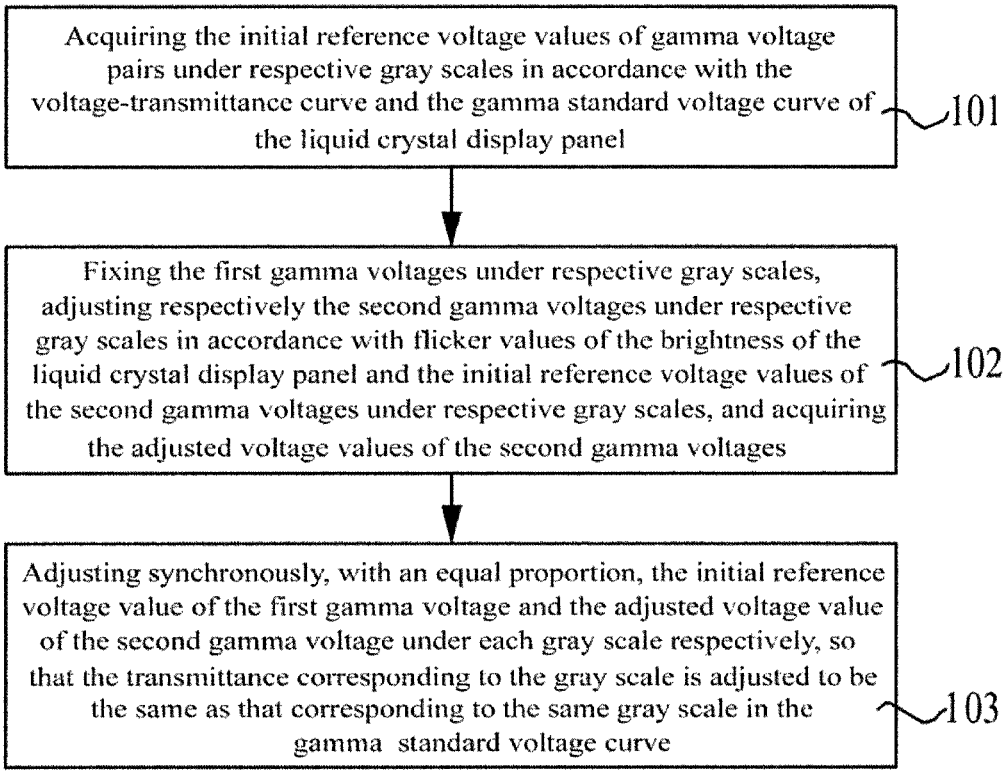
FIG. 1 is a flowchart of an embodiment 1 of a voltage adjustment method of a liquid crystal display panel of the present disclosure.

FIG. 1 is a flowchart of an embodiment 1 of a voltage adjustment method of a liquid crystal display panel of the present disclosure. As shown in FIG. 1, the present embodiment provides a voltage adjustment method of a liquid crystal display panel. The present embodiment may specifically be applied to an FFS mode liquid crystal display panel. The voltage adjustment method of the liquid crystal display panel of the present embodiment may be performed, and the corresponding flow is accomplished by employing a voltage adjustment apparatus of a liquid crystal display panel provided subsequently by an embodiment of the present disclosure. The voltage adjustment method of the liquid crystal display panel of the present embodiment may include specifically steps as follows.

At a step 101, the initial reference voltage values of gamma voltage pairs corresponding to respective gray scales are acquired in accordance with the voltage-transmittance curve and the gamma standard voltage curve of the liquid crystal display panel, the gamma voltage pair including a first gamma voltage and a second gamma voltage.

Figure 2:
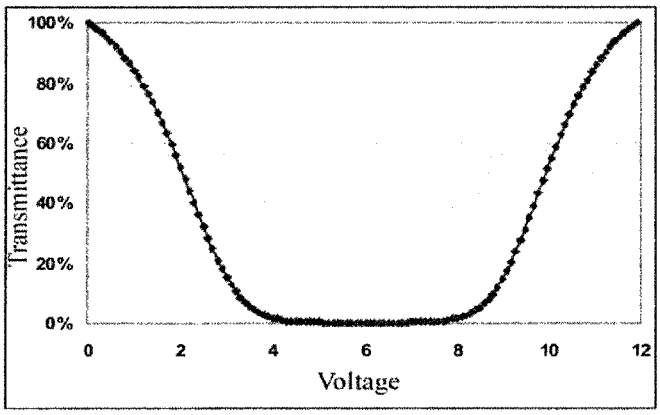
FIG. 2 is a schematic diagram of simulation of a VT curve of the liquid crystal display panel in the embodiment 1 of the voltage adjustment method of the liquid crystal display panel of the present disclosure.

Before the voltage adjustment of the present embodiment is performed, the voltage-transmittance curve, i.e. VT curve, of the liquid crystal display panel may be acquired by testing. FIG. 2 is a schematic diagram of the simulation of a VT curve of the liquid crystal display panel in the embodiment 1 of the voltage adjustment method of the liquid crystal display panel of the present disclosure. As shown in FIG. 2, it is a schematic diagram of the simulation of the VT curve which is bilaterally symmetrical with respect to the voltage value of 6V with its abscissa axis being the voltage value and its ordinate axis being the transmittance, however, the actual VT curve of the liquid crystal display panel is asymmetrical. The gamma standard voltage curve is a transform curve between the output voltage and the corresponding brightness of the liquid crystal display panel, that is, the abscissa axis of the gamma standard voltage curve may be the gray scale value and the ordinate axis thereof may be the brightness value. A gamma voltage pair corresponding to each gray scale in the present embodiment may respectively include a first gamma voltage and a second gamma voltage, in which the first gamma voltage may be a positive electric field voltage while the second gamma voltage may be a negative electric field voltage. Of course, the first gamma voltage may be a negative electric field voltage while the second gamma voltage may be a positive electric field voltage.

The present step is to acquire the initial reference voltage values of gamma voltage pairs corresponding to respective gray scales in accordance with the VT curve and the gamma standard voltage curve of the liquid crystal display panel. Since the VT curve is the correspondence relationship between the voltage value and the transmittance, while the gamma standard voltage curve is the correspondence relationship between the gray scale value and the brightness value, and there is the unique correspondence relationship between the transmittance and the brightness, the initial reference voltage values of the gamma voltage pairs corresponding to respective gray scales may be obtained in accordance with the TV curve and the gamma standard voltage curve, that is, the initial reference voltage values of the first gamma voltages and the initial reference voltage values of the second gamma voltages are obtained.

At a step 102, the first gamma voltages corresponding to respective gray scales are fixed, and the second gamma voltages corresponding to respective gray scales are adjusted respectively in accordance with the flicker values of the brightness of the liquid crystal display panel and the initial reference voltage values of the second gamma voltages corresponding to respective gray scales, and the adjusted voltage values of the second gamma voltages are acquired.

In the present embodiment, after the initial reference voltage values of the gamma voltage pairs corresponding to respective gray scales are acquired, the voltage values of the gamma voltage pairs corresponding to respective gray scales are adjusted. One voltage value of each of gamma voltage pairs may be fixed at first and the other voltage value of the gamma voltage pair is adjusted. Here, it could be that the initial reference voltage values of the first gamma voltages corresponding to respective gray scales are fixed, and the initial reference voltage values of the second gamma voltages corresponding to respective gray scales are adjusted. Specifically, by collecting the flicker values of the brightness of the liquid crystal display panel under the control of gamma voltage pairs corresponding to respective gray scales, the second gamma voltages corresponding to respective gray scales may be adjusted respectively in accordance with the flicker values of the brightness of the liquid crystal display panel and the initial reference voltage values of the second gamma voltages corresponding to respective gray scales, and the adjusted voltage values, which are the optimum voltage values minimizing the flicker values of the brightness of the liquid crystal display panel, of the second gamma voltages are acquired.

At a step 103, the initial reference voltage value of the first gamma voltage and the adjusted voltage value of the second gamma voltage corresponding to each gray scale are respectively adjusted synchronously with an equal proportion, so that the transmittance corresponding to the gray scale is adjusted to be the same as the transmittance corresponding to the same gray scale in the gamma standard voltage curve.

After the voltage adjustment of the above step is completed, the voltage values of the gamma voltage pairs corresponding to respective gray scales are both adjusted to the optimum states, that is, the flicker value of the brightness of the liquid crystal display panel is the minimum under driven by the adjusted voltage values. However, the adjusted voltage values of respective gamma voltage pairs as described above may not match the gamma standard voltage curve, so that the present step needs to further adjust the voltage values of respective gamma voltage pairs. The present step may adjust synchronously, with an equal proportion, the first gamma voltage and the second gamma voltage corresponding to each gray scale, that is, the initial reference voltage value of the first gamma voltage and the adjusted voltage value of the second gamma voltage corresponding to the same gray scale are adjusted simultaneously, and the adjustment proportion for the first gamma voltage and the second gamma voltage are the same. The specific adjustment process takes the gamma standard voltage curve as a reference, performs synchronous adjustment with an equal proportion on the first gamma voltage and the second gamma voltage repeatedly, and finally adjusts the brightness corresponding to each gray scale to be the same as the brightness corresponding to the same gray scale in the gamma standard voltage curve, thus it is equivalent to that the gamma voltage curve of the liquid crystal display panel after the voltage adjustment is matched with the gamma standard voltage curve.

The present embodiment provides a voltage adjustment method of a liquid crystal display panel which acquires the initial reference voltages of the gamma voltage pairs corresponding to respective gray scales in accordance with the VT curve and the gamma standard voltage curve of the liquid crystal display panel at first, and then adjusts the voltage values of the second gamma voltages of the gamma voltage pairs such that the flicker value of the brightness of the liquid crystal display panel is the minimum under the control of the initial reference voltages of the first gamma voltages and the adjusted voltage values of the second gamma voltages, and acquires the adjusted voltage values of the second gamma voltages, and further adjusts the initial reference voltage values of the first gamma voltages and the adjusted voltage values of the second gamma voltages synchronously with an equal proportion such that the gamma voltage curve of the liquid crystal display panel is matched with the gamma standard voltage curve. By adjusting the voltage values of the gamma voltage pairs such that the flicker value of the brightness of the liquid crystal display panel is the minimum, and matching the gamma voltage pair with the gamma standard voltage curve, the present embodiment effectively reduces the generation of direct current biased charges in the liquid crystal cell, and avoid affecting the liquid crystal deflection due to the aggregation of ions in the liquid crystal cell, thus the image sticking phenomenon of the liquid crystal display panel is improved, and the display quality of the liquid crystal display panel is advanced.

Figure 3:
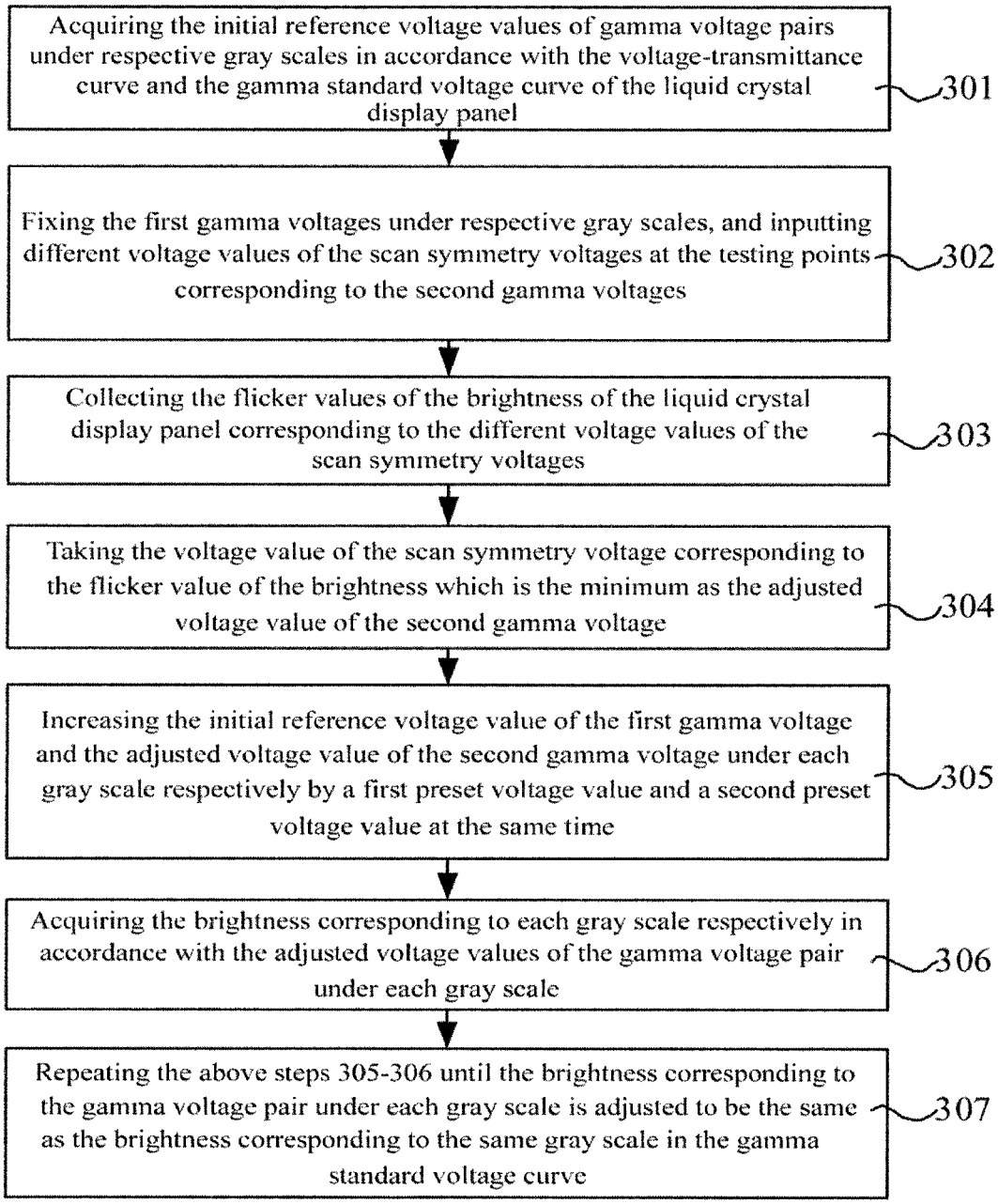
FIG. 3 is a flowchart of an embodiment 2 of the voltage adjustment method of the liquid crystal display panel of the present disclosure.

FIG. 3 is a flowchart of an embodiment 2 of the voltage adjustment method of the liquid crystal display panel of the present disclosure. As shown in FIG. 3, the present embodiment provides a voltage adjustment method of a liquid crystal display panel. The voltage adjustment method of the liquid crystal display panel of the present embodiment may be performed, and the corresponding flow is accomplished by employing a voltage adjustment apparatus of a liquid crystal display panel provided subsequently by an embodiment of the present disclosure. The method may include specifically steps as follows.

At a step 301, the initial reference voltage values of gamma voltage pairs corresponding to respective gray scales are acquired in accordance with the voltage-transmittance curve and the gamma standard voltage curve of the liquid crystal display panel, the gamma voltage pair including a first gamma voltage and a second gamma voltage.

Figure 4:
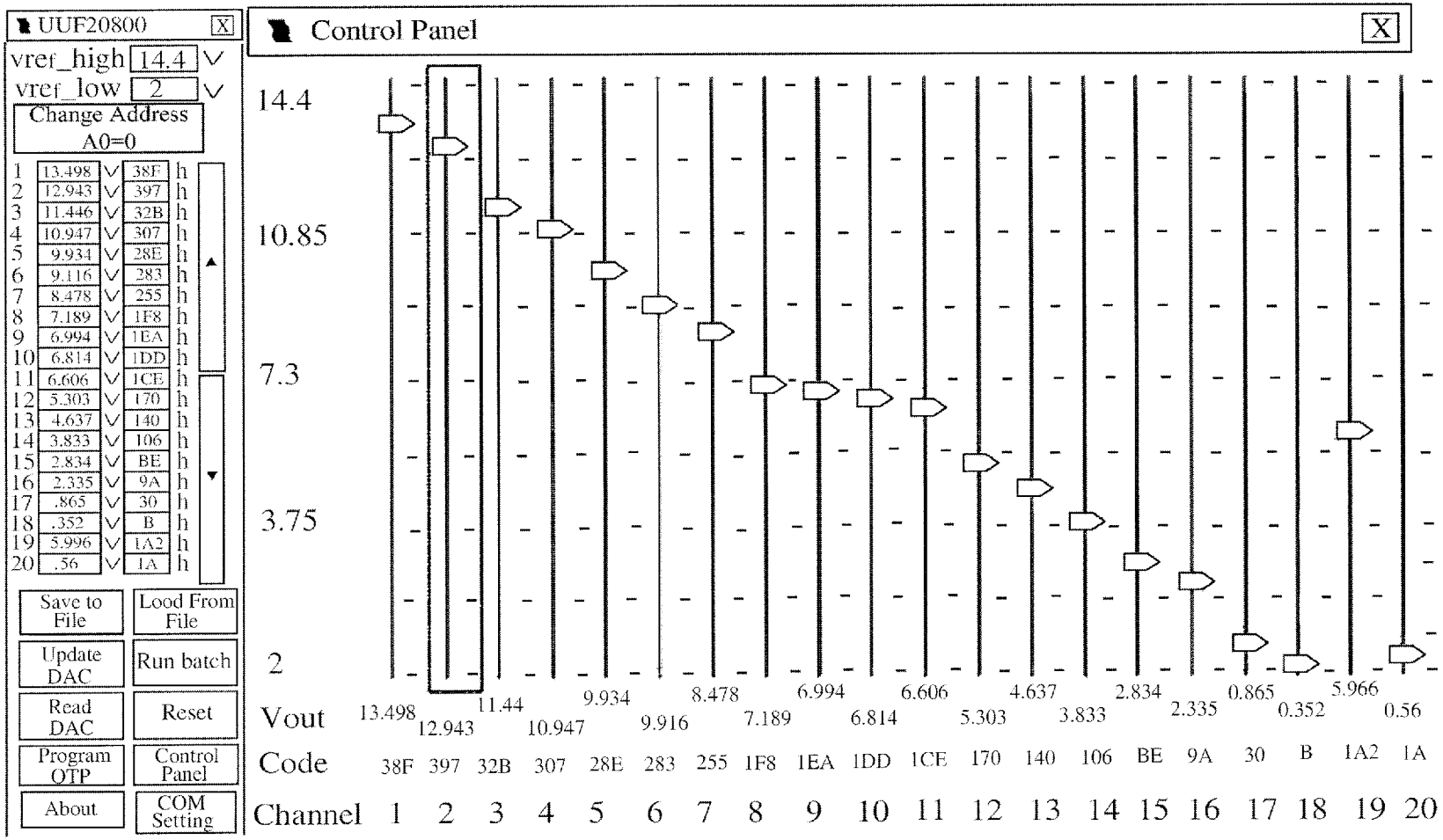
FIG. 4 is a schematic diagram of a timing control board in the embodiment 2 of the voltage adjustment method of the liquid crystal display panel of the present disclosure.

The present step is to acquire the initial reference voltage values of gamma voltage pairs corresponding to respective gray scales in accordance with the VT curve and the gamma standard voltage curve of the liquid crystal display panel. Since the VT curve is the correspondence relationship between the voltage value and the transmittance, while the gamma standard voltage curve is the correspondence relationship between the gray scale value and the brightness value, and there is the unique correspondence relationship between the transmittance and the brightness, the initial reference voltage values of the gamma voltage pairs corresponding to respective gray scales may be obtained in accordance with the TV curve and the gamma standard voltage curve, that is, the initial reference voltage values of the first gamma voltages and the initial reference voltage values of the second gamma voltages are obtained. The present embodiment describes by taking a 32-inch FFS mode television as an example, in which the number of main gray scales is nine, so the number of gamma voltage pairs is nine, which are G1 and G18, G2 and G17, . . . , and G9 and G10 respectively. Here, it can be assumed that G1, G2, . . . and G9 are respectively the first gamma voltages corresponding to respective gray scales, while G10, G11, . . . and G18 are respectively the second gamma voltages corresponding to respective gray scales. In the present embodiment, after the initial reference voltage values of the gamma voltage pairs corresponding to respective gray scales are acquired, the initial reference voltage values can be set on the timing control board of the present embodiment. As shown in FIG. 4, it is a schematic diagram of a timing control board in the embodiment 2 of the voltage adjustment method of the liquid crystal display panel of the present disclosure, in which the magnitudes of specific voltage values of respective gamma voltages can be intuitively shown.

At a step 302, the first gamma voltages corresponding to respective gray scales are fixed, and different voltage values of the scan symmetry voltage are input at the testing points corresponding to the second gamma voltages.

Figure 5:
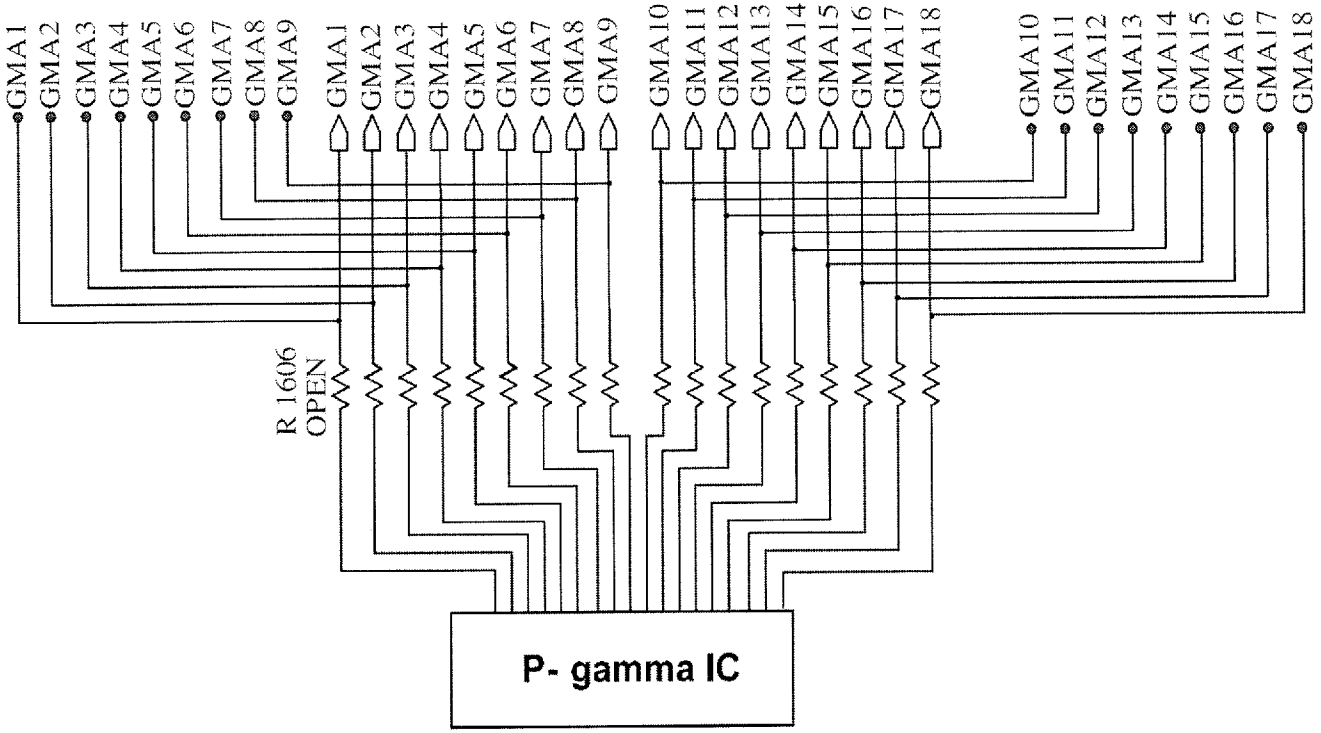
FIG. 5 is a schematic diagram of a simplified structure of a timing control circuitry in the embodiment 2 of the voltage adjustment method of the liquid crystal display panel of the present disclosure.
Figure 6:
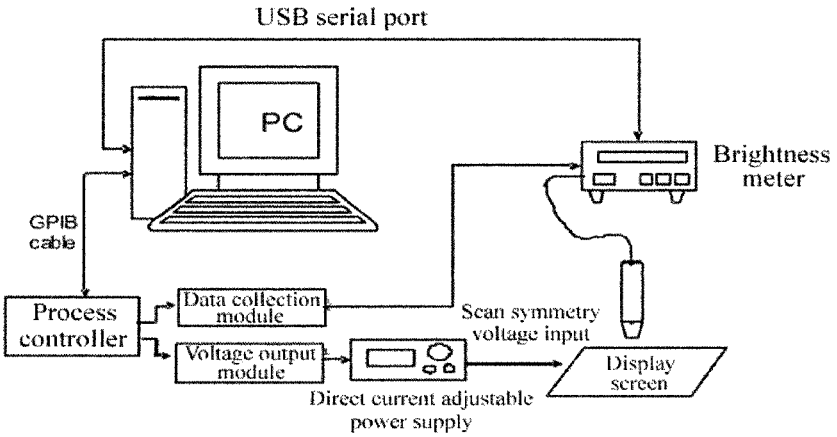
FIG. 6 is a schematic diagram of a simulated structure of a voltage adjustment system in the embodiment 2 of the voltage adjustment method of the liquid crystal display panel of the present disclosure.
Figure 7:
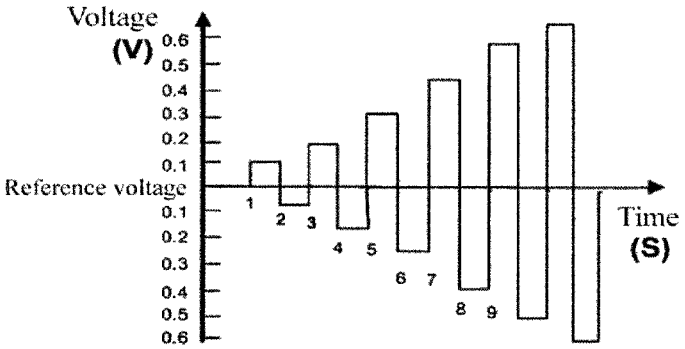
FIG. 7 is a schematic diagram of scan symmetry voltages in the embodiment 2 of the voltage adjustment method of the liquid crystal display panel of the present disclosure.

In the present embodiment, after the initial reference voltage values of the gamma voltage pairs corresponding to respective gray scales are acquired, the voltage values of the gamma voltage pairs corresponding to respective gray scales are adjusted. The initial reference voltage values of the first gamma voltages corresponding to respective gray scales may be fixed, and the initial reference voltage values of the second gamma voltages corresponding to respective gray scales are adjusted. That is, the initial reference voltage values of G1, G2, . . . and G9 may be fixed, and the initial reference voltage values of G10, G11, . . . and G18 are adjusted. FIG. 5 is a schematic diagram of a simplified structure of a timing control circuitry in the embodiment 2 of the voltage adjustment method of the liquid crystal display panel of the present disclosure. As shown in FIG. 5, when the second gamma voltages are adjusted, the adjustment of the voltage values of the second gamma voltages may be implemented by adjusting the corresponding control resistors in the timing control circuitry. Specifically, the adjustment of the control resistors may be controlled by adjusting the direct current voltages input at the testing points. In the present embodiment, the voltage values of the second gamma voltages may be adjusted by inputting different voltage values of the scan symmetry voltage at the testing points corresponding to the second gamma voltages corresponding to respective gray scales. FIG. 6 is a schematic diagram of a simulated structure of a voltage adjustment system in the embodiment 2 of the voltage adjustment method of the liquid crystal display panel of the present disclosure. The present embodiment may specifically use the voltage adjustment system as shown in FIG. 6 to control to input the scan symmetry voltage. That is, under the control of a process controller, a voltage output module may control a direct current adjustable power supply to output different voltage values of the scan symmetry voltage, and input the different voltage values to the liquid crystal display panel so as to realize the adjustment of the voltage values of the second gamma voltages. FIG. 7 is a schematic diagram of the scan symmetry voltages in the embodiment 2 of the voltage adjustment method of the liquid crystal display panel of the present disclosure. As shown in FIG. 7, the scan symmetry voltages in the present embodiment is formed by taking the initial reference voltage values of the second gamma voltages as the centers, and applying symmetrical voltages bilaterally around the centers with the same step length and the same voltage application time as preset. That is, the scan symmetry voltages in the present embodiment is generated from the initial reference voltage values of the second gamma voltages and the preset step length, and the scan symmetry voltages may be generated by taking the initial reference voltage values of the second gamma voltages as reference voltages, and applying a time step length of 1 s with a voltage step length of 0.1 v before and after.

At a step 303, flicker values of the brightness of the liquid crystal display panel corresponding to different values of the scan symmetry voltages are collected.

After the scan symmetry voltages are input to respective testing points on the liquid crystal display panel, flicker values of the brightness of the liquid crystal display panel corresponding to different values are collected. Specifically, the flicker values may be collected by the voltage adjustment system as shown in FIG. 6, that is, under the control of the process controller, the data collection module is controlled to acquire the flicker values of the brightness of the liquid crystal display panel collected by a brightness meter. The present step is to collect, every time when one voltage value of the scan symmetry voltages is input, the flicker value of the brightness of the liquid crystal display panel under the control of the voltage value.

At a step 304, the voltage value of the scan symmetry voltage corresponding to the flicker value of the brightness which is the minimum is taken as the adjusted voltage value of the second gamma voltage.

The present embodiment may repeat the above steps 302 and 303, and the second gamma voltages corresponding to respective gray scales are made fine adjustment with the preset step length. That is, every time it is increased or reduced by 0.1 v on the basis of the initial reference voltage value of the second gamma voltage, the adjusted voltage value is input to the liquid crystal display panel and is maintained for 1 s to acquire its corresponding flicker value of the brightness of the liquid crystal display panel, until the acquired flicker value of the brightness of the liquid crystal display panel is the minimum, and the voltage value of the scan symmetry voltage corresponding to the flicker value which is the minimum is taken as the adjusted voltage value of the second gamma voltage. According to the steps 302 to 304 of the present embodiment, the adjusted voltage values of G10, G11, . . . and G18 are acquired in turn, and at this time, the symmetry between the first gamma voltages and the second gamma voltages corresponding to respective gray scales and the common electrode voltage and other residual charges.

At a step 305, the initial reference voltage value of the first gamma voltage and the adjusted voltage value of the second gamma voltage corresponding to each gray scale are increased respectively by a first preset voltage value and a second preset voltage value at the same time, the first preset voltage value and the second preset voltage value are opposite numbers with each other.

After the optimum adjusted voltage values of the second gamma voltages corresponding to respective gray scales are acquired, the first gamma voltages and the second gamma voltages obtained at this time may not match the gamma standard voltage curve, thus the present embodiment further adjusts the voltage values of the current gamma voltage pairs. At the time of the voltage adjustment, the above voltage adjustment system as shown in FIG. 6 may continue to be employed, and a manner of an externally applied voltage input is employed at the testing point corresponding to each gamma voltage pair, and taking the above adjusted voltage values as a reference, that is, taking the initial reference voltage of the first gamma voltage and the adjusted voltage value of the second gamma voltage as reference voltages, the synchronous adjustment with an equal proportion is performed on the both. At the same time, it is increased by the first preset voltage value on the basis of the initial voltage value of the first gamma voltage, and it is increased by the second preset voltage value on the basis of the adjusted voltage value of the second gamma voltage, the first preset voltage value and the second preset voltage value are opposite numbers with each other in the present embodiment. That is, the first preset voltage value may be a positive voltage of a certain magnitude and the second preset voltage value may be a negative voltage of the same magnitude. That is, the voltage values of G1 and G18, G2 and G17, . . . and G9 and G10 are adjusted synchronously. For a gamma voltage pair corresponding to the same gray scale, the voltage value of the first gamma voltage may be increased by 0.1 v, and the voltage value of the second gamma voltage may be reduced by 0.1 v, so that the symmetry between the voltage values of the first gamma voltage and the second gamma voltage after adjustment is still the same as that before adjustment. That is, it is assumed that the voltage values of the both are symmetrical with respect to the voltage value of 6 v before adjustment, and the voltage values of the both are still symmetrical with respect to the voltage value of 6 v after adjustment.

At a step 306, the brightness corresponding to each gray scale is acquired respectively in accordance with the voltage values of the gamma voltage pair corresponding to each gray scale after adjustment.

After the voltage values of the gamma voltage pair corresponding to each gray scale are synchronously adjusted in turn by performing the above step 305, in accordance with the voltage values of the gamma voltage pair corresponding to each gray scale after adjustment, the brightness corresponding to the gray scale on the liquid crystal display panel at this time is acquired.

At a step 307, the above steps 305-306 are repeated until the brightness corresponding to the gamma voltage pair corresponding to each gray scale is adjusted to be the same as that corresponding to the same gray scale in the gamma standard voltage curve.

Figure 8:
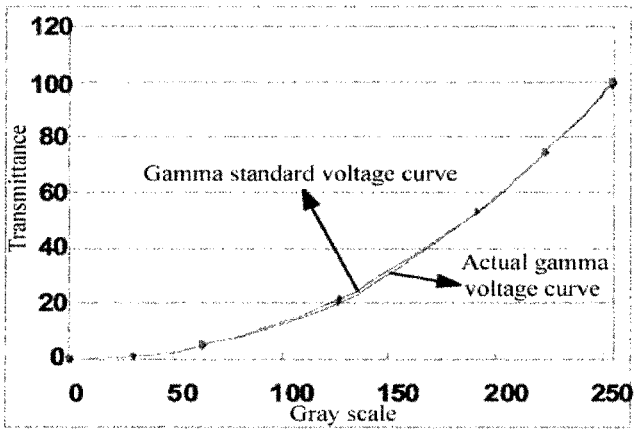
FIG. 8 is a schematic diagram of the comparison of a gamma voltage curve and the gamma standard voltage curve in the embodiment 2 of the voltage adjustment method of the liquid crystal display panel of the present disclosure.

In the present embodiment, after the brightness of the liquid crystal display panel corresponding to the adjusted voltage value is acquired when one synchronous adjustment is completed, it is judged whether the brightness value is the same as the brightness value corresponding to the same gray scale in the gamma standard voltage curve. If the both are the same, the voltage values are taken as the final voltage values of the gamma voltage pair corresponding to the gray scale, and the voltage adjustment process of the present embodiment is finished. Otherwise, if the both are different, the above steps 305-305 are performed repeatedly, and it is continued to synchronously adjust the voltage values of the gamma voltage pair corresponding to the gray scale, until the brightness corresponding to the gamma voltage pair corresponding to each gray scale is adjusted to be the same as that corresponding to the same gray scale in the gamma standard voltage curve, as shown in FIG. 8 which is a schematic diagram of the comparison of a gamma voltage curve and the gamma standard voltage curve in the embodiment 2 of the voltage adjustment method of the liquid crystal display panel of the present disclosure, that is, until the gamma voltage curve corresponding to the adjusted voltage values is the same as the gamma standard voltage curve.

Figure 9:
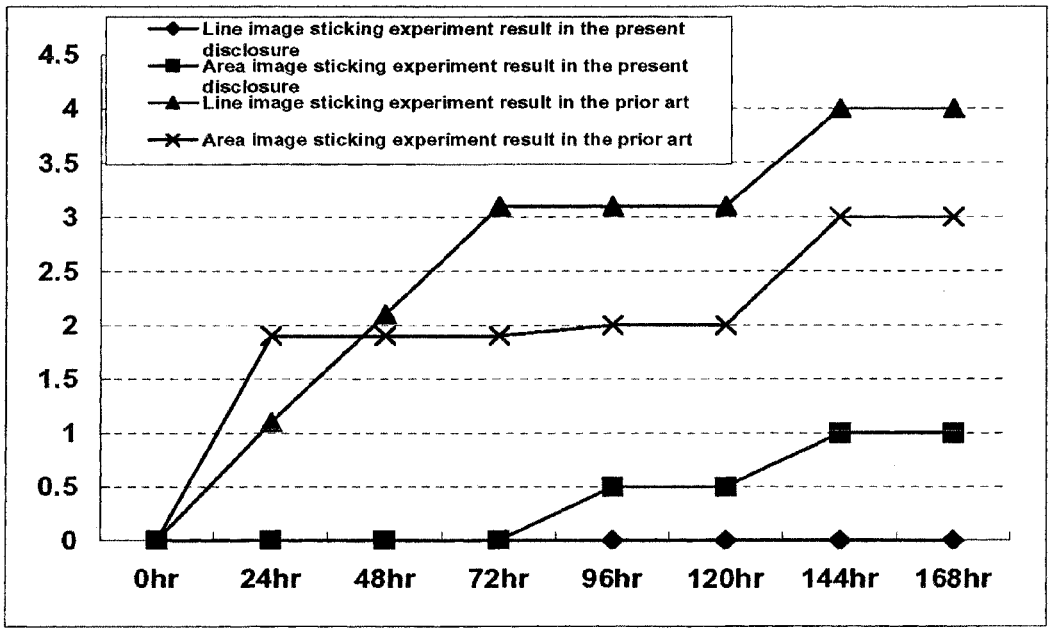
FIG. 9 is a schematic diagram of the comparison of image sticking results of the embodiment 2 of the voltage adjustment method of the liquid crystal display panel of the present disclosure.

FIG. 9 is a schematic diagram of the comparison of image sticking results of the embodiment 2 of the voltage adjustment method of the liquid crystal display panel of the present disclosure. As shown in FIG. 9, it is the comparison between the image sticking result of the liquid crystal display panel obtained after adjusting voltages by the adjustment method of the present embodiment and the image sticking result in the prior art. It can be seen from the figure that the image sticking experiment result tested in the prior art is that the level of the line image sticking is L4@168 hours, and the level of the area image sticking is L3@168 hours, while the image sticking experiment result obtained after adjusting the voltages by using the adjustment method provided by the present disclosure is that the level of the line image sticking is L0@168 hours, and the level of the area image sticking is L1@168 hours. It follows that there is an obvious effect for the improvement on the image sticking of a FFS mode liquid crystal display panel after adjusting the voltage values of the gamma voltage pairs by the voltage adjustment method of the liquid crystal display panel provided by the present embodiment.

The present embodiment provides a voltage adjustment method of a liquid crystal display panel which acquires the initial reference voltages of the gamma voltage pairs corresponding to respective gray scales in accordance with the VT curve and the gamma standard voltage curve of the liquid crystal display panel at first, and then adjusts the voltage values of the second gamma voltages of the gamma voltage pairs such that the flicker value of the brightness of the liquid crystal display panel is the minimum under the control of the initial reference voltages of the first gamma voltages and the adjusted voltage values of the second gamma voltages, and acquires the adjusted voltage values of the second gamma voltages, and further adjusts the initial reference voltage values of the first gamma voltages and the adjusted voltage values of the second gamma voltages synchronously with an equal proportion such that the gamma voltage curve of the liquid crystal display panel is matched with the gamma standard voltage curve. By adjusting the voltage values of the gamma voltage pairs such that the flicker value of the brightness of the liquid crystal display panel is the minimum, and matching the gamma voltage pair with the gamma standard voltage curve, the present embodiment effectively reduces the generation of direct current biased charges in the liquid crystal cell, and avoid affecting the liquid crystal deflection due to the aggregation of ions in the liquid crystal cell, thus the image sticking phenomenon of the liquid crystal display panel is improved, and the display quality of the liquid crystal display panel is advanced.

It can be understood by those ordinary skill in the art that all or a part of steps implementing the above method embodiments may be accomplished by hardware related to program instructions. The program as described above may be stored in a computer readable storage medium, and performs, when executed, steps including the above method embodiment. The storage medium as described above includes all kinds of media such as ROM, RAM, disk or compact disk which can store program codes.

Figure 10:
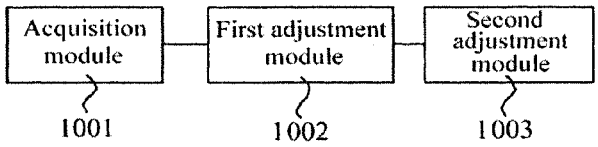
FIG. 10 is a schematic diagram of the structure of an embodiment 1 of a voltage adjustment apparatus of a liquid crystal display panel of the present disclosure.

FIG. 10 is a schematic diagram of the structure of an embodiment 1 of a voltage adjustment apparatus of a liquid crystal display panel of the present disclosure. As shown in FIG. 10, the present embodiment provides a voltage adjustment apparatus of a liquid crystal display panel which can perform the technical solution of the embodiment 1 of the voltage adjustment method of the liquid crystal display panel provided by the embodiment of the present disclosure, and has the corresponding functional modules. The voltage adjustment apparatus of the liquid crystal display panel provided by the present embodiment may specifically have an acquisition module 1001, a first adjustment module 1002 and a second adjustment module 1003. The acquisition module 1001 is used for acquiring the initial reference voltage values of the gamma voltage pairs corresponding to respective gray scales in accordance with the voltage-transmittance curve and the gamma standard voltage curve of the liquid crystal display panel, the gamma voltage pair including a first gamma voltage and a second gamma voltage. The first adjustment module 1002 is used for fixing the first gamma voltages corresponding to respective gray scales, adjusting respectively the second gamma voltages corresponding to respective gray scales in accordance with the flicker values of the brightness of the liquid crystal display panel and the initial reference voltage values of the second gamma voltages corresponding to respective gray scales, and acquiring the adjusted voltage values of the second gamma voltages. The second adjustment module 1003 is used for respectively adjusting synchronously, with an equal proportion, the initial reference voltage value of the first gamma voltage and the adjusted voltage value of the second gamma voltage corresponding to each gray scale, so that the brightness corresponding to the gray scale is adjusted to be the same as the brightness corresponding to the same gray scale in the gamma standard voltage curve.

Figure 11:
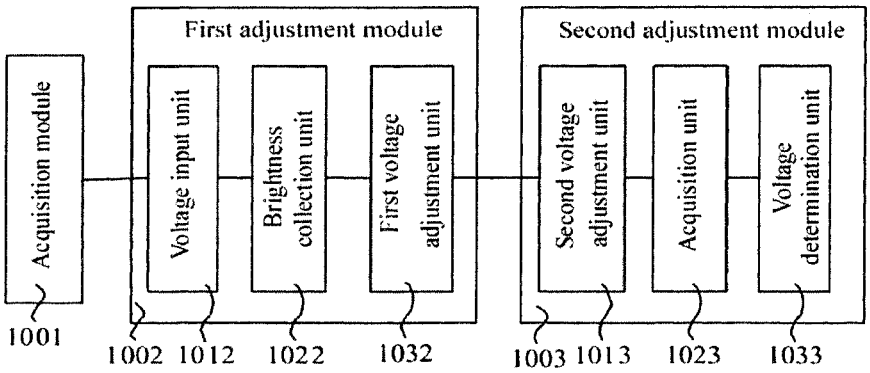
FIG. 11 is a schematic diagram of the structure of an embodiment 2 of a voltage adjustment apparatus of a liquid crystal display panel of the present disclosure.

FIG. 11 is a schematic diagram of the structure of an embodiment 2 of a voltage adjustment apparatus of a liquid crystal display panel of the present disclosure. As shown in FIG. 11, the present embodiment provides a voltage adjustment apparatus of a liquid crystal display panel which can perform the technical solution of the embodiment 2 of the voltage adjustment method of the liquid crystal display panel provided by the embodiment of the present disclosure, and has the corresponding functional modules. The first adjustment module 1002 in the voltage adjustment apparatus of the liquid crystal display panel provided by the present embodiment may specifically include a voltage input unit 1012, a brightness collection unit 1022 and a first voltage adjustment unit 1032. The voltage input unit 1012 is used for inputting different voltage values of scan symmetry voltages at the testing points corresponding to the second gamma voltages, the scan symmetry voltages are generated with a preset step length in accordance with the initial reference voltage values of the second gamma voltages. The brightness collection unit 1022 is used for collecting the flicker values of the brightness of the liquid crystal display panel corresponding to the different voltage values of the scan symmetry voltages. The first voltage adjustment unit 1032 is used for taking the voltage value of the scan symmetry voltage corresponding to the flicker value of the brightness which is the minimum as the adjusted voltage value of the second gamma voltage in accordance with the collection result of the brightness collection unit 1022.

Specifically, the second adjustment module 1003 in the voltage adjustment apparatus of the liquid crystal display panel provided by the present embodiment may specifically include a second voltage adjustment unit 1013, an acquisition unit 1023 and a voltage determination unit 1033. The second voltage adjustment unit 1023 is used for increasing the initial reference voltage value of the first gamma voltage and the adjusted voltage value of the second gamma voltage corresponding to each gray scale respectively by a first preset voltage value and a second preset voltage value at the same time, the first preset voltage value and the second preset voltage are opposite numbers with each other. The acquisition unit 1023 is used for acquiring the brightness corresponding to each gray scale respectively in accordance with the voltage values of the adjusted gamma voltage pair corresponding to each gray scale. The voltage determination unit 1033 is used for repeating the above steps performed by the second voltage adjustment unit 1013 and the acquisition unit 1023, until the brightness corresponding to the gamma voltage pair corresponding to each gray scale is adjusted to be the same as that corresponding to the same gray scale in the gamma standard voltage curve.

The present embodiment provides a voltage adjustment apparatus of a liquid crystal display panel which acquires the initial reference voltages of the gamma voltage pairs corresponding to respective gray scales in accordance with the VT curve and the gamma standard voltage curve of the liquid crystal display panel at first, and then adjusts the voltage values of the second gamma voltages of the gamma voltage pairs such that the flicker value of the brightness of the liquid crystal display panel is the minimum under the control of the initial reference voltages of the first gamma voltages and the adjusted voltage values of the second gamma voltages, and acquires the adjusted voltage values of the second gamma voltages, and further adjusts the initial reference voltage values of the first gamma voltages and the adjusted voltage values of the second gamma voltages synchronously with an equal proportion such that the gamma voltage curve of the liquid crystal display panel is matched with the gamma standard voltage curve. By adjusting the voltage values of the gamma voltage pairs such that the flicker value of the brightness of the liquid crystal display panel is the minimum, and matching the gamma voltage pairs with the gamma standard voltage curve, the present embodiment effectively reduces the generation of direct current biased charges in the liquid crystal cell, and avoid affecting the liquid crystal deflection due to the aggregation of ions in the liquid crystal cell, thus the image sticking phenomenon of the liquid crystal display panel is improved, and the display quality of the liquid crystal display panel is advanced.

Finally, it should be noted that the above embodiments are used only for explaining the technical solutions of the present disclosure, and are not limiting thereof. Although the detailed description is made to the present disclosure with reference to the above embodiments, those ordinary skill in the art should understand that they still can make modification to the technical solutions described in the respective embodiments as described above or make equivalent replacement to a part of technical features therein, and such modification or replacement do not make the essences of corresponding technical solutions depart from the spirit and the scope of the technical solutions of respective embodiments of the present disclosure.

What is claimed is:

1. A voltage adjustment method of a liquid crystal display panel for eliminating image sticking, comprising:

acquiring initial reference voltage values of a gamma voltage pair corresponding to a gray scale in accordance with a voltage-transmittance curve and a gamma standard voltage curve of the liquid crystal display panel, the gamma voltage pair including a first gamma voltage and a second gamma voltage;

fixing the first gamma voltage corresponding to the gray scale as an initial reference voltage value of the first gamma voltage corresponding to the gray scale, collecting a flicker value of brightness of the liquid crystal display panel by inputting a scan symmetry voltage, wherein the scan symmetry voltage is formed by taking an initial reference voltage value of the second gamma voltage as a center and applying symmetrical voltages bilaterally around the center with a same step length and a same voltage application time as preset;

taking a voltage value of the scan symmetry voltage which corresponds to a minimum value of the flicker value as an adjusted voltage value of the second gamma voltage corresponding to the gray scale;

adjusting synchronously, in opposite directions by an equal magnitude, the initial reference voltage value of the first gamma voltage and the adjusted voltage value of the second gamma voltage corresponding to the gray scale respectively, so that brightness corresponding to the gray scale is adjusted to be same as brightness corresponding to the same gray scale in the gamma standard voltage curve.

2. The method according to claim 1, wherein said adjusting synchronously, with an equal proportion, the initial reference voltage value of the first gamma voltage and the adjusted voltage value of the second gamma voltage corresponding to the gray scale respectively so that the brightness corresponding to the gray scale is adjusted to be same as the brightness corresponding to the same gray scale in the gamma standard voltage curve comprises:

increasing the initial reference voltage value of the first gamma voltage and the adjusted voltage value of the second gamma voltage corresponding to the gray scale respectively by a first preset voltage value and a second preset voltage value at the same time, wherein the first preset voltage value and the second preset voltage value have a same magnitude but opposite signs;

acquiring the brightness corresponding to the gray scale in accordance with the adjusted voltage values of the gamma voltage pair corresponding to the gray scale; and repeating above steps until the brightness corresponding to the gamma voltage pair corresponding to the gray scale is adjusted to be same as that corresponding to the same gray scale in the gamma standard voltage curve.

3. A voltage adjustment apparatus of a liquid crystal display panel for eliminating image sticking, comprising:

an acquisition module configured to acquire initial reference voltage values of a gamma voltage pair corresponding to a gray scale in accordance with a voltage-transmittance curve and a gamma standard voltage curve of the liquid crystal display panel, the gamma voltage pair including a first gamma voltage and a second gamma voltage;

a first adjustment module configured to fix the first gamma voltage corresponding to the gray scale as an initial reference voltage value of the first gamma voltage corresponding to the gray scale, to collect a flicker value of brightness of the liquid crystal display panel by inputting a scan symmetry voltage, wherein the scan symmetry voltage is formed by taking an initial reference voltage value of the second gamma voltage as a center and applying symmetrical voltages bilaterally around the center with a same step length and a same voltage application time as preset;

and to take a voltage value of the scan symmetry voltage which corresponds to a minimum value of the flicker value as an adjusted voltage value of the second gamma voltage corresponding to the gray scale;

a second adjustment module configured to adjust synchronously, in opposite directions by an equal magnitude, the initial reference voltage value of the first gamma voltage and the adjusted voltage value of the second gamma voltage corresponding to the gray scale respectively, so that brightness corresponding to the gray scale is adjusted to be same as brightness corresponding to the same gray scale in the gamma standard voltage curve.

4. The apparatus according to claim 3, wherein the second adjustment module comprises:

a second voltage adjustment unit configured to increase the initial reference voltage value of the first gamma voltage and the adjusted voltage value of the second gamma voltage corresponding to the gray scale respectively by a first preset voltage value and a second preset voltage value at the same time, wherein the first preset voltage value and the second preset voltage value have a same magnitude but opposite signs;

an acquisition unit configured to acquire the brightness corresponding to the gray scale in accordance with the adjusted voltage values of the gamma voltage pair corresponding to the gray scale; and a voltage determination unit configured to repeat above steps performed by the second voltage adjustment unit and the acquisition unit until the brightness corresponding to the gamma voltage pair corresponding to the gray scale is adjusted to be same as that corresponding to the same gray scale in the gamma standard voltage curve.

* * * * *